US009267088B2

(12) United States Patent
Tock et al.

(10) Patent No.: US 9,267,088 B2
(45) **Date of Patent: *Feb. 23, 2016**

(54) FUELS FOR COLD START CONDITIONS

(75) Inventors: Richard William Tock, Humbolt, IA (US); James Kenneth Sanders, Lubbock, TX (US); Duck Joo Yang, Flower Mound, TX (US)

(73) Assignee: James K. and Mary A. Sanders Family LLC, Lubbock, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/449,638

(22) Filed: Apr. 18, 2012

(65) Prior Publication Data

US 2012/0198759 A1 Aug. 9, 2012

Related U.S. Application Data

(63) Continuation of application No. 12/415,041, filed on Mar. 31, 2009, now Pat. No. 8,182,554.

(51) Int. Cl.

| | |
|---|---|
| ***C10L 1/12*** | (2006.01) |
| ***C10L 1/10*** | (2006.01) |
| ***C10L 10/00*** | (2006.01) |
| ***C10L 10/02*** | (2006.01) |
| ***C10L 10/08*** | (2006.01) |
| *C10L 1/16* | (2006.01) |

(52) U.S. Cl.

CPC ..... *C10L 1/1233* (2013.01); *C10L 1/10* (2013.01); *C10L 10/00* (2013.01); *C10L 10/02* (2013.01); *C10L 10/08* (2013.01); *C10L 1/1608* (2013.01); *C10L 2200/0213* (2013.01); *C10L 2250/06* (2013.01)

(58) Field of Classification Search

CPC ..... C10L 1/1233; C10L 1/10; C10L 10/00; C10L 10/02; C10L 10/08; C10L 1/1608; C10L 2200/0213; C10L 2250/06

USPC ..... 44/357, 457

See application file for complete search history.

(56) References Cited

U.S. PATENT DOCUMENTS

| | | | | |
|---|---|---|---|---|
| 5,266,082 | A * | 11/1993 | Sanders | 44/357 |
| 5,433,756 | A | 7/1995 | Gonzalez | |
| 5,525,316 | A | 6/1996 | Shustorovich et al. | |
| 5,823,758 | A | 10/1998 | Lack | |
| 5,951,722 | A * | 9/1999 | Sanders et al. | 44/354 |
| 6,110,237 | A | 8/2000 | Spencer et al. | |
| 6,113,660 | A | 9/2000 | Hubbard et al. | |
| 6,152,972 | A | 11/2000 | Shustorovich et al. | |
| 6,312,480 | B1 | 11/2001 | Jakob et al. | |

(Continued)

OTHER PUBLICATIONS

U.S. Office Action for U.S. Appl. No. 12/415,041 mailed on Dec. 1, 2011.

(Continued)

*Primary Examiner* — Cephia D Toomer

(74) *Attorney, Agent, or Firm* — Amin, Turocy & Watson, LLP

(57) ABSTRACT

A fuel composition contains a liquid fuel and nano-sized zinc oxide particles. The nano-sized zinc oxide particles can be used to either improve cold start performance of internal combustion engines or lower a flash point temperature of a liquid fuel.

20 Claims, 2 Drawing Sheets

(56) References Cited

U.S. PATENT DOCUMENTS

| | | | | |
|---|---|---|---|---|
| 6,866,010 | B2 | 3/2005 | May | |
| 7,229,482 | B2 | 6/2007 | May | |
| 8,163,044 | B2 * | 4/2012 | Mills | 44/457 |
| 8,182,554 | B2 * | 5/2012 | Tock et al. | 44/357 |
| 8,182,555 | B2 * | 5/2012 | Tock et al. | 44/357 |
| 2006/0254130 | A1 | 11/2006 | Scattergood | |

OTHER PUBLICATIONS

U.S. Office Action for U.S. Appl. No. 12/415,041 mailed on Jun. 23, 2011.

International Search Report for International Application No. PCT/US 08/66016 dated Aug. 19, 2008.

Written Opinion of the International Searching Authority for International Application No. PCT/US 08/66016 dated Aug. 19, 2008.

* cited by examiner

FUELS FOR COLD START CONDITIONS

CROSS-REFERENCE TO RELATED APPLICATIONS

This application is a Continuation of application Ser. No. 12/415,041 filed on Mar. 31, 2009, which is incorporated herein by reference.

TECHNICAL FIELD

Provided are fuel compositions containing liquid fuels and nano-sized zinc oxide particles and methods of improving cold start performance of internal combustion engines.

BACKGROUND

Engine manufacturers and fuel suppliers continue to seek improved fuel economy and improved emission quality through engine design and formulating new fuels. There is pressure to minimize engine crank times and time from key-on to drive-away, while maintaining maximum fuel economy. Those pressures apply to engines fueled with alternative fuels such as ethanol as well as to those fueled with gasoline.

During cold temperature engine start, conventional spark ignition internal combustion engines are characterized by high hydrocarbon emissions, poor fuel ignition, and poor combustibility. Unless the engine is already at a high temperature after stop and hot-soak, the crank time may be excessive, or the engine may not start at all. At higher speeds and loads, the operating temperature increases and fuel atomization and mixing improve.

The worst emissions are during the first few minutes of engine operation, after which the catalyst and engine approach operating temperature. Regarding ethanol fueled vehicles, as the ethanol percentage fraction of the fuel increases to 100%, the ability to cold start becomes increasingly diminished, leading some engine manufacturers to include a dual fuel system in which engine start is fueled with conventional gasoline and engine running is fueled with the ethanol grade.

SUMMARY

The following presents a simplified summary of the innovation in order to provide a basic understanding of some aspects of the innovation. This summary is not an extensive overview of the innovation. It is intended to neither identify key or critical elements of the innovation nor delineate the scope of the innovation. Rather, the sole purpose of this summary is to present some concepts of the innovation in a simplified form as a prelude to the more detailed description that is presented hereinafter.

The subject innovation provides nano-sized zinc oxide particles that can be used to improve cold start performance of internal combustion engines. The nano-sized zinc oxide particles can be also used to lower flash point temperatures of liquid fuels.

One aspect of the innovation relates to a fuel composition containing a liquid fuel and nano-sized zinc oxide particles. Another aspect of the innovation relates to methods of lowering a flash point temperature of a liquid fuel. Yet another aspect of the innovation relates to methods of increasing an engine speed and an exhaust gas temperature of an internal combustion engine.

To the accomplishment of the foregoing and related ends, the innovation comprises the features hereinafter fully described and particularly pointed out in the claims. The following description and the annexed drawings set forth in detail certain illustrative aspects and implementations of the innovation. These are indicative, however, of but a few of the various ways in which the principles of the innovation may be employed. Other objects, advantages and novel features of the innovation will become apparent from the following detailed description of the innovation when considered in conjunction with the drawings.

DETAILED DESCRIPTION

Figure 1:
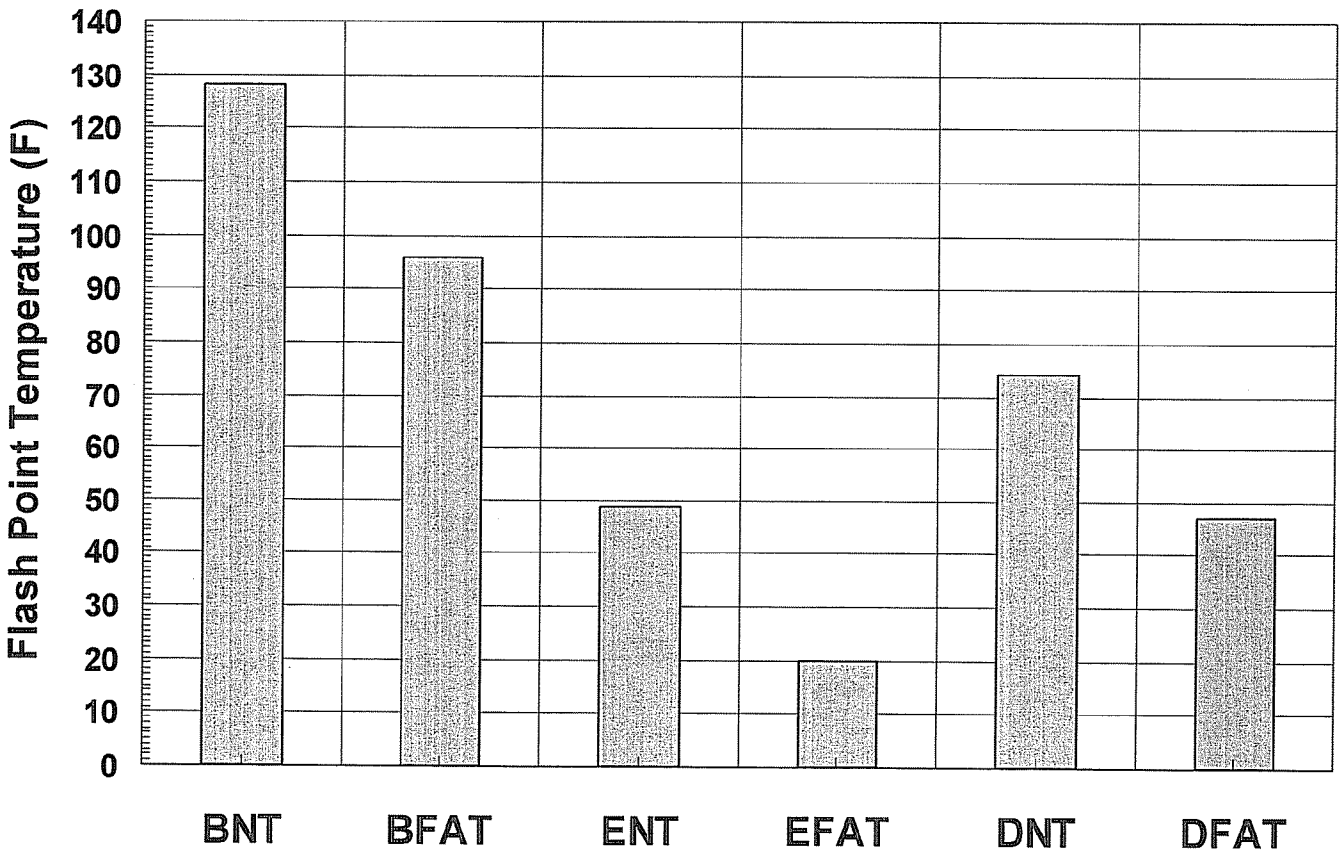
FIG. 1 is a bar graph illustrating flash point temperatures of three different fuels without nano-sized zinc oxide particles and with nano-sized zinc oxide particles.

Fuels having a high flash point temperature may have poor cold start properties. For example, alcohol fuels typically a higher flash point temperature and, one of the negative aspects arising from the use of alcohol fuels is their poor cold start properties. There are at least two significant factors involved with cold starts that retard or prevent engine turnover under cold temperature starting conditions.

One factor involves the properties of increased friction and viscosity with the lubrication fluids used in the engine. The second factor arises from the reduced vapor pressure of the alcohol-based fuel, again as the result of the low temperature. In this latter case, the ethanol cannot vaporize or reach the vapor phase in sufficient quantities to sustain a combustion process. Therefore, both factors, which arise due to sub ambient temperatures, must be modified or eliminated if the automobile engine is to start and continue to run in extreme, cold weather conditions.

Heaters (e.g., electrical resistance heaters) can be used in the engine block to keep the oil warm and thereby reduce or minimize retarding friction and viscosity effects. The use of these heating devices becomes mandatory under the most extreme cold weather conditions where engine oils begin to gel or even solidify. However, the heater used to keep the engine oil liquid and fluid cannot be used with liquid fuels to ameliorate their conditions of reduced vapor pressure.

Therefore, higher volatile fuel components may be added to the fuel to increase the vapor pressure. This practice leads fuel suppliers in northern areas to modifying their fuel products on a seasonal basis, so that winter fuels have a different composition containing lower boiling components than fuels to be used in the summer. This refinery practice may create problems of fuel supply and demand whenever the onset of a seasonal change arrives early or is delayed.

The subject innovation described herein relates to a fuel composition that contains a liquid fuel and an additive that facilitates to reduce or eliminate cold start problems associated with fuels. In particular, the subject innovation relates to a fuel composition that contains a liquid fuel and nano-sized zinc oxide particles. Containing the nano-sized zinc oxide particles in the fuel composition, cold startability (e.g., cold-start performance) is improved. For example, when providing an internal combustion engine with the fuel composition, an engine speed and an exhaust gas temperature of the internal combustion engine during cold start are increased.

Nano-sized zinc oxide particles are combined with fuel to improve fuel combustion. The nano-sized zinc oxide particles may be present in a fuel additive composition that is combined (that is, either suspended or dispersed) with fuel to make a fuel composition, or present in a fuel composition.

While not wishing to be bound by any theory, when nano-sized zinc oxide particles are present in a liquid fuel composition that is oxidized in the combustion process, an added energy source is provided. The nano-sized zinc oxide particles may increase the catalytic chemical oxidation or combustion of hydrocarbon based fuels. Consequently, an increase in engine power is achieved, and cold startability is improved.

Still not wishing to be bound by any theory, it is believed that nano-sized zinc oxide particles present in a liquid fuel composition provide a catalytic surface capable of supplying oxygen to the combustion process during transient reducing atmospheric episodes generated by the combustion process. Since the combustion process is more complete, an environmentally friendly internal combustion engine fuel is provided.

The nano-sized zinc oxide particles may also be involved in other reactions that improve the combustion. For example, the nano-sized zinc oxide particles can sequester low levels of water which otherwise can contaminate fuels, especially those fuels containing oxygenates such as alcohol. It is believed that this sequestration with the presence of ethanol provides an added benefit by decreasing the sensitivity or difference between research octane number (RON) and motor octane number (MON) levels for ethanol. The decrease in sensitivity increases the fuels performance when the engine is under load and can give rise to an increased octane rating for the fuel.

Nano-sized zinc oxide particles are added to hydrocarbon based fuels to improve cold-start performance (e.g., about first five minutes following ignition). Combustion processes (oxidation of hydrocarbon fuels) can be an order of magnitude faster by a substantially heterogeneous reaction on solid catalytic surfaces (provided by the nano-sized zinc oxide particles) than do the same oxidation processes in homogeneous gas phase reactions without the zinc oxide particles. The subject innovation thus provides nano-sized solid catalyst having a significantly increased surface area needed for more complete combustion.

The nano-sized zinc oxide particles have a size suitable to catalyze the combustion reaction of fuels, yet have 1) an ability to pass through fuel filters and 2) at least substantially combust themselves, or sublime, or otherwise be consumed so that particulate emissions are minimized and/or eliminated. In one embodiment, the nano-sized zinc oxide particles have a size where at least about 90% by weight of the particles have a size from about 1 nm to about 50 nm. In this connection, size refers to average cross-section of a particle, such as diameter. In another embodiment, the nano-sized zinc oxide particles have a size where at least about 90% by weight of the particles have a size from about 1 nm to about 40 nm. In yet embodiment, the nano-sized zinc oxide particles have a size where at least about 90% by weight of the particles have a size from about 1.5 nm to about 30 nm. In still yet embodiment, the nano-sized zinc oxide particles have a size where at least about 90% by weight of the particles have a size from about 2 nm to about 20 nm. In still yet embodiment, the nano-sized zinc oxide particles have a size where at least about 90% by weight of the particles have a size from about 5 nm to about 10 nm. In another embodiment, about 100% by weight of the particles have any of the sizes described above, including a size of less than about 20 nm.

The nano-sized zinc oxide particles have a surface area suitable to catalyze the combustion reaction of fuels and to increase the rate of combustion compared to using the same amount of catalyst in bulk form. Increased surface area is often better achieved via small sized particles rather than particles with high porosity. In one embodiment, the nano-sized zinc oxide particles have a surface area from about 50 $m^2/g$ to about 1,000 $m^2/g$. In another embodiment, the nano-sized zinc oxide particles have a surface area from about 100 $m^2/g$ to about 750 $m^2/g$. In yet another embodiment, the nano-sized zinc oxide particles have a surface area from about 150 $m^2/g$ to about 600 $m^2/g$.

The nano-sized zinc oxide particles have a morphology suitable to catalyze the combustion reaction of fuels, increase the rate of combustion compared to using the same amount of catalyst in bulk form, yet have an ability to pass through fuel filters. Examples of the one or more morphologies the nano-sized zinc oxide particles may have include, spherical, substantially spherical, oval, popcorn-like, plate-like, cubic, pyramidal, cylindrical, and the like. The nano-sized zinc oxide particles may be crystalline, partially crystalline, or amorphous.

In one embodiment, the nano-sized zinc oxide particles do not contain health hazardous and environmentally non-friendly (by current or future standards) metals and metal oxides. For example, in one embodiment, the nano-sized zinc oxide particles do not substantially contain lead and/or lead oxide.

Nano-sized zinc oxide particles are commercially available from a number of sources including Sigma-Aldrich Inc. Alternatively, zinc oxides can be made by converting a zinc salt to zinc oxide by methods known in the art. The conversion can take place in an inert atmosphere or in air via heating, such as calcining in an inert or atmospheric environment or heating in solution. In one embodiment, a zinc salt is dissolved in a liquid and subjected to ultrasound irradiation followed by its conversion to zinc oxide.

Any suitable zinc salt can be employed in the subject innovation. Examples of zinc salts include zinc carboxylates, zinc halides, and zinc acetylacetonates. That is, zinc carboxylates, zinc halides, and zinc acetylacetonates may be used to make zinc oxides. Specific examples of zinc carboxylates include zinc acetates, zinc ethylhexanoates, zinc gluconates, zinc oxalates, zinc propionates, zinc pantothenates, zinc cyclohexanebutyrates, zinc bis(ammonium lacto)dihydroxides, zinc citrates, and zinc methacrylates. Other examples of zinc salts include zinc chloride, zinc nitrate, zinc sulfate, zinc borate, zinc bromate, zinc chromate, zinc phenolsulfonate, zinc thiocyanate.

Any suitable liquid can be used to convert a zinc salt such as a zinc carboxylate to a zinc oxide. Examples of liquids include water and organic solvents such as alcohols, ethers, esters, ketones, alkanes, aromatics, and the like. When using an absolute alcohol such as absolute ethanol as the liquid, the alcohol complexes with water may be liberated during the conversion process.

In one embodiment, suitable particle size distribution of the nano-sized particles is established or facilitated by sonochemistry. Sonochemistry is the science of using the acoustic energy in ultrasound to bring about physical and chemical changes. Ultrasound is broadly defined as sound having a frequency above about 18-20 kHz (the upper limit of human hearing) to about 100 MHz. Ultrasound having a frequency less than above 5 MHz can be useful for sonochemistry since it can produce cavitation in liquids, the source of chemical effects.

The sonochemical treatment can be conducted by any suitable time. In one embodiment, the sonochemical treatment is conducted during forming the nano-sized particles (e.g., when converting a zinc salt to zinc oxide). In another embodiment, the sonochemical treatment is conducted after forming the nano-sized particles. In yet another embodiment, the sonochemical treatment is conducted during and after forming the nano-sized particles.

The sonochemical treatment can be conducted by any suitable technique. In one embodiment, a zinc salt is dissolved in the liquid to provide a mixture, and the mixture is treated by ultrasound with a probe (e.g., an ultrasound horn or ultrasonic horn) that transmits ultrasound vibrations. The ultrasound horn can be immersed in the liquid where the ultrasound vibrations are transmitted directly to the mixture. In one embodiment, the sonochemical treatment forms a slurry of the mixture. The sonochemical treatment can be performed in any suitable manner. For example, ultrasound vibrations are transmitted to the mixture in a batch reactor, continuous flow reactor, semi-continuous flow reactor, or the like.

The ultrasound irradiation is applied under any suitable condition to facilitate the uniformity of dispersion, duration of suspension, and/or suitable particle size distribution of the nano-sized particles. The conditions depend upon, for example, the desirable particle size distribution, constituent of the zinc salt, concentration of the zinc salt in the mixture, and the like. Examples of conditions include an intensity, a frequency, a period of time, and the like.

Any suitable intensity of ultrasound irradiation can be employed to facilitate the uniformity of dispersion, duration of suspension, and/or suitable particle size distribution of the nano-sized particles. In one embodiment, intensity of ultrasound irradiation is from about 0.005 $W/cm^2$ or more and about 50 $W/cm^2$ or less. In another embodiment, intensity of ultrasound irradiation is from about 0.01 $W/cm^2$ or more and about 10 $W/cm^2$ or less. In yet another embodiment, intensity of ultrasound irradiation is from about 0.1 $W/cm^2$ or more and about 5 $W/cm^2$ or less.

Any suitable frequency of the ultrasound can be employed. In one embodiment, a frequency is about 20 kHz or more and about 10 MHz or less. In another embodiment, a frequency is about 20 kHz or more and about 1 MHz or less. In yet another embodiment, a frequency is about 20 kHz or more and about 100 kHz or less The ultrasound irradiation can be contacted with the mixture for a sufficient time to facilitate suitable particle size distribution of nano-sized particles. In one embodiment, the suitable particle size distribution of nano-sized particles is formed by sonochemistry for about 1 minute or more and about 1 hour or less. In another embodiment, the suitable particle size distribution of nano-sized particles is formed by sonochemistry for about 2 minutes or more and about 50 minutes or less. In yet another embodiment, the suitable particle size distribution of nano-sized particles is formed by sonochemistry for about 3 minutes or more and about 40 minutes or less.

In one embodiment, the ultrasound irradiation is carried out until nano-sized zinc oxide particles have a size where at least about 90% by weight of the particles have a size from about 1 nm to about 50 nm, and then stopped. In another embodiment, the ultrasound irradiation is carried out until nano-sized zinc oxide particles have a size where at least about 90% by weight of the particles have a size from about 1 nm to about 40 nm, and then stopped. In yet embodiment, the ultrasound irradiation is carried out until nano-sized zinc oxide particles have a size where at least about 90% by weight of the particles have a size from about 1.5 nm to about 30 nm, and then stopped. In still yet embodiment, the ultrasound irradiation is carried out until nano-sized zinc oxide particles have a size where at least about 90% by weight of the particles have a size from about 2 nm to about 20 nm, and then stopped. In still yet embodiment, the ultrasound irradiation is carried out until nano-sized zinc oxide particles have a size where at least about 90% by weight of the particles have a size from about 5 nm to about 10 nm, and then stopped. In another embodiment, the ultrasound irradiation is carried out until about 100% by weight of the particles have any of the sizes described above, including a size of less than about 20 nm, and then stopped.

Methods of making zinc oxide particles are known in the art and described in U.S. Pat. Nos. 5,039,509; 5,106,608; 5,654,456; 6,179,897 (combining metal with graphite, heating to form an intermediate metal carbide, applying apply more heat to decompose the metal carbide and release the metal as a vapor, then oxidizing to form a pure metal oxide powder); PCT Publication No. WO/2007/000014; all of which are hereby incorporated by reference.

The nano-sized zinc oxide particles can be at least partially suspended, but typically suspended, in a liquid fuel composition in any suitable manner. The relatively small size of the nano-size particles contributes to the inherent ability to remain suspended over a longer period of time compared to relatively larger particles (larger than a micron), even though the density and/or specific gravity of the nano-size particles may be several times greater than the corresponding density and/or specific gravity of the liquid fuel. The longer suspension times mean that the liquid fuel containing the nano-size particles entering the engine over time contains a more uniform and/or consistent dispersion of the nano-size particles.

A suspension contains the nano-sized zinc oxide particles and a carrier fluid that is compatible with the fuel. For example, when the nano-sized particles are made in the alcohol solution, or when toluene or xylenes are used as a carrier fluid, the resulting suspension can be added directly to a liquid fuel (e.g. alcohol fuel). Analogously, for diesel fuels, another carrier fluid which is more of a cetane enhancer can be employed.

The nano-sized zinc oxide particles can be in dry powder form. The powdered form may be prepared by spray drying a suspension of the nano-sized zinc oxide particles. An inert gas such as nitrogen can be used to spray dry the particles. The coated powder can then be added to fuel or an engine as a powder or made into a fuel compatible paste. The powder can be directly added into the air intake of an engine instead of adding the powder to the fuel.

The uniformity of dispersion and/or duration of suspension can also be established or facilitated by mixing, stirring, blending, shaking, sonicating, or otherwise agitating the liquid fuel composition containing the nano-size particles.

The liquid fuel composition contains a suitable amount of at least partially suspended nano-sized zinc oxide particles to catalyze the combustion reaction of fuels (e.g., to increase an engine speed and an exhaust gas temperature of an internal combustion engine or to lower a flash point temperature of a liquid fuel). In one embodiment, the liquid fuel composition contains a liquid fuel and from about 0.01 ppm to about 100 ppm of suspended nano-sized zinc oxide particles. In another embodiment, the liquid fuel composition contains a liquid fuel and from about 0.05 ppm to about 80 ppm of suspended nano-sized zinc oxide particles. In yet another embodiment, the liquid fuel composition contains a liquid fuel and from about 0.1 ppm to about 60 ppm of suspended nano-sized zinc oxide particles. In still yet another embodiment, the liquid fuel composition contains a liquid fuel and from about 1 ppm to about 50 ppm of suspended nano-sized zinc oxide particles.

A fuel additive composition provides an efficient means to store and transport the nano-sized zinc oxide particles prior to the addition with a liquid fuel. In one embodiment, the fuel additive composition is simply a dry powder. In another embodiment, the fuel additive composition is a paste containing from about 10% by weight to about 95% by weight of the nano-sized zinc oxide particles and from about 5% by weight to about 90% by weight of a fuel compatible organic solvent. In yet embodiment, the fuel additive composition is a combination of a carrier liquid and the nano-sized zinc oxide particles.

The fuel composition or fuel additive composition may optionally contain a bicyclic aromatic compound. Examples of bicyclic aromatic compounds include naphthalene, substituted naphthalenes, biphenyl compounds, biphenyl compound derivatives, and mixtures thereof. In one embodiment, the fuel composition contains from about 0.01 ppm to about 1,000 ppm while the fuel additive composition contains from about 0.1% by weight to about 10% by weight of one or more bicyclic aromatic compounds. In another embodiment, the fuel composition contains from about 0.1 ppm to about 500 ppm while the fuel additive composition contains from about 0.5% by weight to about 5% by weight of one or more bicyclic aromatic compounds.

The nano-sized zinc oxide particles and the optional bicyclic aromatic compound in the fuel additive composition can be dispersed in a carrier liquid to form a fuel additive composition. A carrier liquid has a flash point less than 100 degrees Fahrenheit and an auto-ignition temperature less than 400 degrees Fahrenheit or is a C1-C3 alcohol. Examples of carrier liquids include one or more of toluene, xylenes, kerosene, and C1-C3 monohydric, dihydric or polyhydric aliphatic alcohols. Examples of aliphatic alcohols include methanol, ethanol, n-propanol, isopropyl alcohol, ethylene glycol, propylene glycol, and the like. In one embodiment, the fuel additive composition contains at least about 90% by weight of a carrier liquid and no more than about 10% by weight of the nano-sized zinc oxide particles.

Some fuels and fuel additives contain relatively large or small quantities of ketones, such as acetone, or ethers, such methyl tertiary butyl ether (MTBE). A relatively large or small quantity of a ketone or ether is not necessary in the fuel compositions and fuel additive compositions. In one embodiment, a relatively large quantity (more than about 5% by volume) of a ketone or ether is not present in the fuel compositions and/or fuel additive compositions because ketones and ethers may decrease the solubility of the nano-sized zinc oxide particles.

Fuel compositions are made by combining the nano-sized zinc oxide particles and a liquid fuel. Examples of liquid fuels include hydrocarbon fuels that have poor cold start properties. For example, liquid fuels that have a high flash point temperature can be employed in the subject innovation. In one embodiment, a liquid fuel has a flash point temperature higher than about 25 degrees Fahrenheit. In another embodiment, a liquid fuel has a flash point temperature higher than about 30 degrees Fahrenheit. In yet another embodiment, a liquid fuel has a flash point temperature higher than about 35 degrees Fahrenheit. In still yet another embodiment, a liquid fuel has a flash point temperature higher than about 40 degrees Fahrenheit. In another embodiment, a liquid fuel has a flash point temperature higher than about 45 degrees Fahrenheit.

The subject innovation can employ any hydrocarbon fuel that has a high flash point temperature. Specific examples of such fuels include alcohol fuel (e.g., alcohol containing fuel), diesel, and the like. Examples of alcohol fuels include methanol fuels (methanol-containing fuels), ethanol fuels (e.g., ethanol-containing fuels), and the like. Today, the primary alcohol fuel is ethanol fuel, which is typically made synthetically or from grain (e.g., corn, wheat, barley, and oats) in a fermentation process. The ethanol can be blended into gasoline in various quantities. Premium gasoline, with a higher octane rating than regular gasoline, is primarily gasoline with 10% ethanol (E10). Other examples of ethanol fuels include E15 (15% ethanol and 85% gasoline), E85 (85% ethanol and 15% gasoline), and E100 (100% ethanol). Still other examples of alcohol fuels include M85 (85% methanol and 15% gasoline). In one embodiment, E100 has a flash point temperature of about 50 degrees Fahrenheit.

Diesel (e.g., diesel fuel) in general is any fuel used in diesel engines. Examples of diesel include petroleum diesel (e.g., petrodiesel) and non-petroleum diesel that is not derived from petroleum. Petroleum diesel is produced from petroleum and is a hydrocarbon mixture, obtained in the fractional distillation of crude oil between about 200° C. and about 350° C. at atmospheric pressure. Examples of non-petroleum diesel fuels include biodiesel, biomass to liquid (BTL) diesel, gas to liquid (GTL) diesel, and the like. Biodiesel refers to a non-petroleum-based diesel fuel containing short chain alkyl (methyl or ethyl) esters, made by transesterification of vegetable oil. Ultra-low sulfur diesel (ULSD) can also be used in the subject innovation.

The fuel composition can be effectively used in both fuel-injected and non fuel-injected engines. The fuel composition can be effectively used in two-stroke engines, four-stroke engines, and vehicle engines such as automobile engines, motorcycle engines, jet engines, marine engines, truck/bus engines, and the like. The fuel composition can be effectively used in any type of internal combustion engine including an Otto-cycle engine, a diesel engine, a rotary engine, and a gas turbine engine. The fuel composition can be effectively used in an intermittent internal combustion engine or a continuous internal combustion engine. The fuel composition can supply to the fuel chamber the liquid fuel and the nano-sized zinc oxide particles as a mixture, or the liquid fuel and the nano-sized zinc oxide particles can be supplied to the fuel chamber separately.

The fuel compositions can be tailored to advantageously lower a flash point temperature of a liquid fuel. The flash point of a flammable liquid is the lowest temperature at which it can form an ignitable mixture in air. The nano-sized zinc oxide particles at low concentration levels (e.g., from about 0.01 ppm to about 100 ppm) can reduce the surface tension of liquid fuels, which permits the fuels to be vaporized at the reduced ambient temperatures associated with cold starts of internal combustion engines.

In one embodiment, the fuel additive composition or the nano-sized zinc oxide particles is/are added to the liquid fuel in an amount sufficient to provide decrease of at least about 10% in a flash point temperature (Fahrenheit) of the liquid fuel as compared to the flash point temperature of the liquid fuel without inclusion of the nano-sized zinc oxide particles. In another embodiment, the fuel additive composition or the nano-sized zinc oxide particles is/are added to the liquid fuel in an amount sufficient to provide decrease of at least about 20% in a flash point temperature (Fahrenheit) of the liquid fuel. In another embodiment, the fuel additive composition or the nano-sized zinc oxide particles is/are added to the liquid fuel in an amount sufficient to provide decrease of at least about 25% in a flash point temperature (Fahrenheit) of the liquid fuel.

Containing a liquid fuel and nano-sized zinc oxide particles in a fuel composition, the fuel composition's flash point temperature is lowered. In one embodiment, when the fuel composition contains a liquid fuel and about 0.01 ppm to about 100 ppm of nano-sized zinc oxide particles, the flash point temperature (Fahrenheit) of the fuel composition is lowered by about 10% to about 80% as compared to the flash point temperature of the liquid fuel without inclusion of the nano-sized zinc oxide particles. In another embodiment, when the fuel composition contains a liquid fuel and about 0.01 ppm to about 100 ppm of nano-sized zinc oxide particles, the flash point temperature (Fahrenheit) of the fuel composition is lowered by about 20% to about 70% as compared to the flash point temperature of the liquid fuel without inclusion of the nano-sized zinc oxide particles. In yet another embodiment, when the fuel composition contains a liquid fuel and about 0.01 ppm to about 100 ppm of nano-sized zinc oxide particles, the flash point temperature (Fahrenheit) of the fuel composition is lowered by about 25% to about 60% as compared to the flash point temperature of the liquid fuel without inclusion of the nano-sized zinc oxide particles.

The fuel compositions can also be tailored to increase an engine speed and/or an exhaust gas temperature of an internal combustion engine, thereby improving cold startability. The nano-sized zinc oxide particles can function to form a coating on metal parts within the internal combustion engine, thereby not only adding lubricity but also preventing carbon deposition on the internal engine parts. A portion of the nano-sized zinc oxide particles in the fuel composition can be retained in the engine oil after combustion, and thereby facilitate reducing sliding friction between pistons of the engine and the cylinder walls. This reduction in friction improves cold startability.

Any suitable portion of the nano-sized zinc oxide particles can be retained in the engine oil in the engine and the rest of the particles are exhausted from the engine with the flow of the exhaust gas. In one embodiment, about 70% or more of particles in the fuel composition is retained in the engine after combustion. In another embodiment, about 75% or more of particles in the fuel composition is retained in the engine after combustion. In yet another embodiment, about 80% or more of particles in the fuel composition is retained in the engine after combustion.

During engine start-up and normal operating conditions, temperature parameters are typically sensed to establish corresponding fuel pressures at a fuel injector inlet. Temperature parameters to determine the operational characteristics of the engine can be measured at a plurality of locations within an engine, its exhaust system, or its cooling system. Normal operating conditions typically exist after an engine has been running and its operating temperature range has been reached, such as, for example, a normal coolant temperature of about 195 degrees Fahrenheit at the outlet of a water pump to an inlet of a radiator.

Under cold start conditions, an engine speed is low and an exhaust gas temperature is typically below its normal operating temperature range since less fuel is actually being combusted in the engine. In one embodiment, cold start conditions mean first five minutes following ignition. In another embodiment, during engine cold start conditions a coolant temperature at an outlet of a water pump to an inlet of a radiator is below its normal operating temperature range (e.g., about 195 degrees Fahrenheit).

In one embodiment, the fuel additive composition or the nano-sized zinc oxide particles coated is/are added to the liquid fuel in an amount sufficient to provide increase of at least about 10% in an engine speed (rpm) and/or an exhaust gas temperature (Fahrenheit) of an engine as compared to the corresponding engine speed and/or exhaust gas temperature from use of the liquid fuel without inclusion of the nano-sized zinc oxide particles. In another embodiment, the fuel additive composition or the nano-sized zinc oxide particles is/are added to the liquid fuel in an amount sufficient to provide increase of at least about 20% in an engine speed (rpm) and/or an exhaust gas temperature (Fahrenheit) of an engine as compared to the corresponding engine speed and/or exhaust gas temperature from use of the liquid fuel without inclusion of the nano-sized zinc oxide particles. In yet another embodiment, the fuel additive composition or the nano-sized zinc oxide particles is/are added to the liquid fuel in an amount sufficient to provide increase of at least about 30% in an engine speed (rpm) and/or an exhaust gas temperature (Fahrenheit) of an engine as compared to the corresponding engine speed and/or exhaust gas temperature from use of the liquid fuel without inclusion of the nano-sized zinc oxide particles.

Containing a liquid fuel and nano-sized zinc oxide particles in a fuel composition, the fuel composition exhibits an increased engine speed and/or an exhaust gas temperature. In one embodiment, when the fuel composition contains a liquid fuel and about 0.01 ppm to about 100 ppm of nano-sized zinc oxide particles, an engine speed (rpm) and/or an exhaust gas temperature (Fahrenheit) during the first five minutes following ignition are increased by about 10% to about 70%. In another embodiment, when the fuel composition contains a liquid fuel and about 0.01 ppm to about 100 ppm of nano-sized zinc oxide particles, an engine speed (rpm) and/or an exhaust gas temperature (Fahrenheit) during the first five minutes following ignition are increased by about 20% to about 60%. In yet another embodiment, when the fuel composition contains a liquid fuel and about 0.01 ppm to about 100 ppm of nano-sized zinc oxide particles, an engine speed (rpm) and/or an exhaust gas temperature (Fahrenheit) during the first five minutes following ignition are increased by about 30% to about 55%.

The following examples illustrate the subject innovation. Unless otherwise indicated in the following examples and elsewhere in the specification and claims, all parts and percentages are by weight, all temperatures are in degrees Fahrenheit, and pressure is at or near atmospheric pressure.

Table 1 reports flash point temperatures of three different fuels without nano-sized zinc oxide particles and with nano-sized zinc oxide particles. Biodiesel fuels without and with the nano-sized oxide particles are designated as BNT and BFAT, respectively. The biodiesel fuel is available from Baron USA Inc. E100 commercial ethanol fuels without and with the nano-sized oxide particles are designated as ENT and EFAT, respectively. The E100 commercial ethanol fuel is available from Biofuel Industries. Pump diesel fuels without and with the nano-sized oxide particles are designated as DNT and DFAT, respectively. The pump diesel fuel is available from any commercial diesel fuel retailer (e.g., any of the major oil companies). The nano-sized zinc oxide particles are present at a level of about 50 ppm and are zinc oxide particles having a size from 5 nm to 20 nm. A flash point temperature of a fuel composition is measured using ASTM D7215-08.

TABLE 1

| Sample ID | Fuel | Nano-sized ZnO particles (ppm) | Flash Point Temperature (F.) |
|---|---|---|---|
| BNT | Biodiesel | 0 | 128 |
| BFAT | | 50 | 96 |
| ENT | E100 | 0 | 49 |
| EFAT | Ethanol | 50 | 20 |
| DNT | Pump | 0 | 74 |
| DFAT | Diesel | 50 | 47 |

FIG. 1 is a bar graph for flash point temperatures to facilitate visual comparisons of addition of nano-sized zinc oxide particles reported in Table 1. On the bar graph of FIG. 1, BFAT (biodiesel with ZnO particles) advantageously shows a lower flash point than BNT (biodiesel without ZnO particles). EFAT (E100 ethanol with ZnO particles) advantageously shows a lower flash point than ENT (E100 ethanol without ZnO particles). DFAT (diesel with ZnO particles) advantageously shows a lower flash point than DNT (diesel without ZnO particles). For the three fuels, the reduction in flash point temperature is substantial.

Table 2 reports average engine speeds (rpm) and average exhaust gas temperatures (Fahrenheit) of a engine during first five minutes following ignition using E100 ethanol fuel without nano-sized zinc oxide particles and E100 ethanol fuel with nano-sized zinc oxide particles. The E100 ethanol fuel is available from Biofuel Industries. The nano-sized zinc oxide particles are present at a level of about 50 ppm and are zinc oxide particles having a size from 5 nm to 20 nm. The engine is a year 2002 Ford F-150 pick-up V-8, a year 2000 Dodge Ram pick-up V-8, a 1999 Audi A8 V-8.

TABLE 2

| Test Description | E100 without nano-sized ZnO particles | E100 with nano-sized ZnO particles 50 ppm |
|---|---|---|
| Average engine speed (rpm) | 691 | 945 |
| Average exhaust gas temperature (F.) | 406 | 572 |

Figure 2:
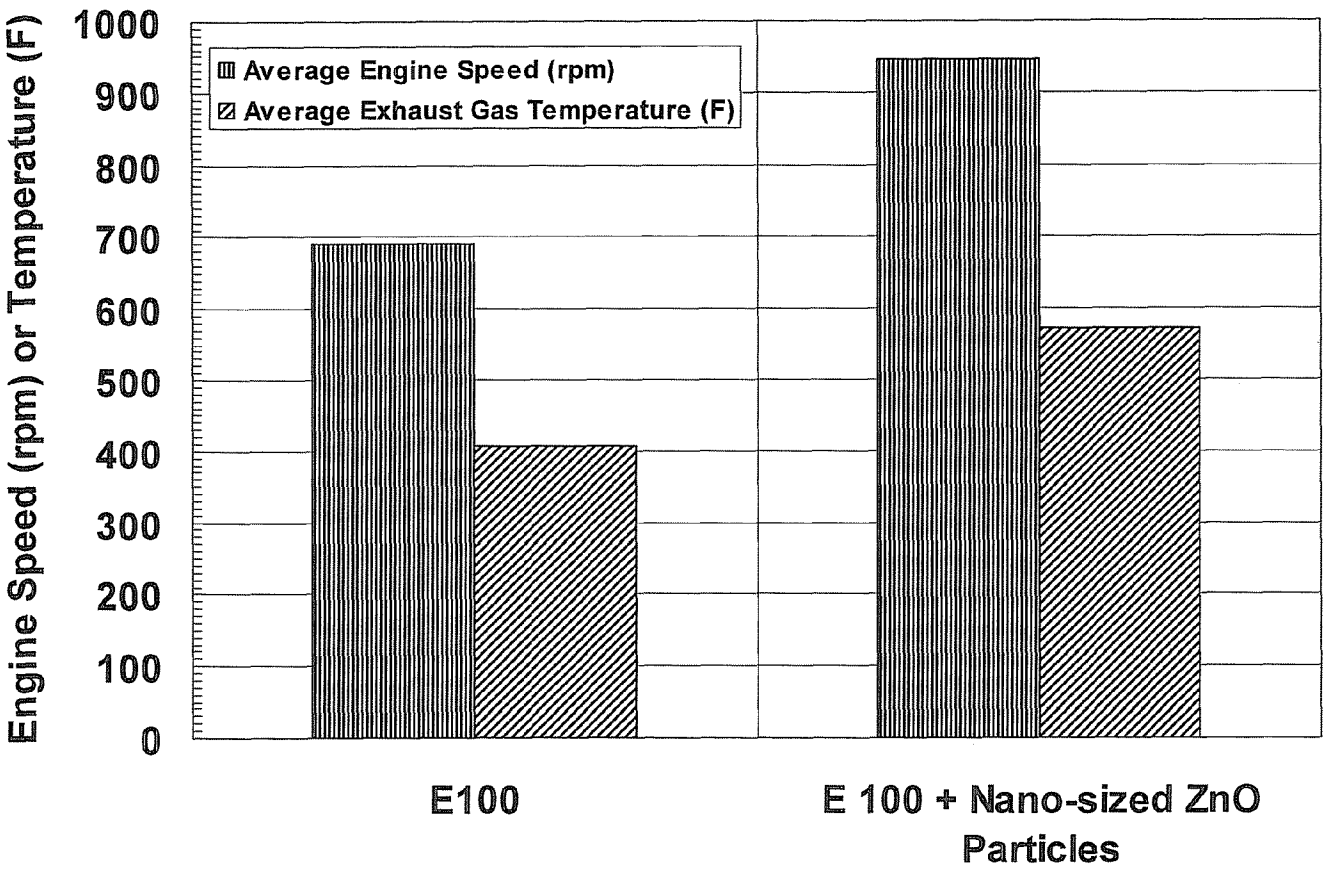
FIG. 2 is a bar graph illustrating average engine speeds and average exhaust gas temperatures of an engine during first five minutes following ignition.

FIG. 2 is a bar graph for average engine speeds and average exhaust gas temperatures of a engine during first five minutes following ignition reported in Table 2. On the bar graph of FIG. 2, the first set of bars (E100) shows the average engine speed and average exhaust gas temperature of the engine during first five minutes following ignition using E100 ethanol fuel without nano-sized zinc oxide particles. The second set of bars (E100+Nano-sized ZnO Particles) shows the average engine speed and average exhaust gas temperature of the engine during first five minutes following ignition using E100 ethanol fuel with nano-sized zinc oxide particles. For the ethanol fuel with nano-sized zinc oxide particles, increase in both average engine speed and average exhaust gas temperature is substantial. The average engine speed when using the ethanol fuel with nano-sized zinc oxide particles is increased by about 47%. The average exhaust gas temperature when using the ethanol fuel with nano-sized zinc oxide particles is increased by about 41%.

With respect to any figure or numerical range for a given characteristic, a figure or a parameter from one range may be combined with another figure or a parameter from a different range for the same characteristic to generate a numerical range.

While the innovation has been explained in relation to certain embodiments, it is to be understood that various modifications thereof will become apparent to those skilled in the art upon reading the specification. Therefore, it is to be understood that the innovation disclosed herein is intended to cover such modifications as fall within the scope of the appended claims.

What is claimed is:

1. A method of improving cold starts of an internal combustion engine by lowering a flash point temperature of a liquid fuel, comprising:

providing the internal combustion engine with the liquid fuel selected from the group consisting of alcohol fuel and diesel;

providing the internal combustion engine with a fuel additive, the fuel additive comprising from about 0.01 ppm to about 50 ppm of nano-sized zinc oxide particles to lower the flash point temperature by about 20%, where at least about 90% by weight of the nano-sized zinc oxide particles have a size from about 1 nm to about 50 nm, wherein the fuel additive further comprises a carrier liquid, the carrier liquid having a flash point temperature less than 100 degrees Fahrenheit and an auto-ignition temperature less than 400 degrees Fahrenheit;

lowering the flash point temperature of the liquid fuel by at least about 10% compared to a same liquid fuel without the nano-sized zinc oxide particles, and increasing by about 20% engine speed and exhaust gas temperature during a cold start compared to a same liquid fuel without the nano-sized zinc oxide particles; and retaining at least 70 percent of the nano-sized zinc oxide particles in an engine oil in the internal combustion engine after combustion of the liquid fuel, thereby reducing sliding friction between a piston and a cylinder wall of the engine.

2. The method of claim 1, wherein the nano-sized zinc oxide particles have a surface area from about 50 $m^2/g$ to about 1,000 $m^2/g$.

3. The method of claim 1, wherein the fuel additive comprises less than 5 percent by volume of a ketone or ether.

4. The method of claim 1, wherein at least about 90% by weight of the nano-sized zinc oxide particles have a size from about 1 nm to about 40 nm.

5. The method of claim 1, wherein at least about 90% by weight of the particles have a size from about 5 nm to about 10 nm.

6. The method of claim 1, wherein the liquid fuel is ethanol fuel.

7. The method of claim 1, wherein the liquid fuel comprises from about 0.01 ppm to about 50 ppm of the nano-sized zinc oxide particles having a substantially spherical shape.

8. A method of increasing an engine speed and an exhaust gas temperature of an internal combustion engine by lowering a flash point temperature of a fuel composition, comprising:

providing the internal combustion engine with the fuel composition comprising a liquid fuel and a fuel additive, the liquid fuel selected from the group consisting of alcohol fuel and diesel, the fuel additive comprising from about 0.01 ppm to about 50 ppm of nano-sized zinc oxide particles to lower a flash point temperature of the liquid fuel by about 20%, at least about 90% by weight of the nano-sized zinc oxide particles having a size from about 1 nm to about 50 nm, and a carrier liquid having a flash point temperature less than 100 degrees Fahrenheit and an auto-ignition temperature less than 400 degrees Fahrenheit;

increasing the engine speed by at least about 20% compared to a fuel composition comprising the liquid fuel but no nano-sized zinc oxide particles, and increasing engine speed and exhaust gas temperature during a cold start compared to a same liquid fuel without the nano-sized zinc oxide particles;

increasing the exhaust gas temperature by about 20% for about the first 5 minutes of operation of the internal combustion engine compared to the fuel composition comprising the liquid fuel but no nano-sized zinc oxide particles; and retaining at least 70 percent of the nano-sized zinc oxide particles in an engine oil in the internal combustion engine after combustion of the liquid fuel, thereby reducing sliding friction between a piston and a cylinder wall of the engine.

9. The method of claim 8 comprising increasing an engine speed by at least 30%.

10. The method of claim 8, wherein the nano-sized zinc oxide particles have a surface area from about 50 $m^2/g$ to about 1,000 $m^2/g$.

11. The method of claim 8, wherein the fuel composition comprises less than 5 percent by volume of a ketone or ether.

12. The method of claim 8, wherein at least about 90% by weight of the nano-sized zinc oxide particles have a size from about 1 nm to about 40 nm.

13. The method of claim 8, wherein at least about 90% by weight of the nano-sized zinc oxide particles have a size from about 5 nm to about 10 nm.

14. The method of claim 8, wherein the liquid fuel is ethanol fuel.

15. A method of lowering a flash point temperature of a liquid fuel selected from the group consisting of alcohol fuel and diesel, the liquid fuel, comprising:

combining the liquid fuel with a fuel additive to lower the flash point temperature of the liquid fuel, the fuel additive comprising from about 0.01 ppm to about 50 ppm of nano-sized zinc oxide particles, where at least about 90% by weight of the nano-sized zinc oxide particles have a size from about 1 nm to about 50 nm, wherein the fuel additive further comprises a carrier liquid, the carrier liquid having a flash point temperature less than 100 degrees Fahrenheit and an auto-ignition temperature less than 400 degrees Fahrenheit;

lowering a flash point temperature of the liquid fuel by at least about 20% compared to a same liquid fuel without the nano-sized zinc oxide particles, and increasing by about 20% engine speed and exhaust gas temperature during a cold start compared to a same liquid fuel without the nano-sized zinc oxide particles; and retaining at least 70 percent of the nano-sized zinc oxide particles in an engine oil in the internal combustion engine after combustion of the liquid fuel, thereby reducing sliding friction between a piston and a cylinder wall of the engine.

16. The method of claim 15, wherein the nano-sized zinc oxide particles have a surface area from about 50 $m^2/g$ to about 1,000 $m^2/g$.

17. The method of claim 15, wherein the the fuel additive comprises less than 5 percent by volume of a ketone or ether.

18. The method of claim 15, wherein at least about 90% by weight of the nano-sized zinc oxide particles have a size from about 1 nm to about 40 nm.

19. The method of claim 15, wherein at least about 90% by weight of the nano-sized zinc oxide particles have a size from about 5 nm to about 10 nm.

20. The method of claim 15, wherein the liquid fuel is ethanol fuel.

* * * * *